US011628994B2

(12) United States Patent
McCree et al.

(10) Patent No.: US 11,628,994 B2
(45) Date of Patent: Apr. 18, 2023

(54) CARRIER FOR CONTAINERS

(71) Applicant: Graphic Packaging International, LLC, Atlanta, GA (US)

(72) Inventors: Justin McCree, Bristol (GB); Steve M. Gould, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 17/487,113

(22) Filed: Sep. 28, 2021

(65) Prior Publication Data

US 2022/0097940 A1 Mar. 31, 2022

Related U.S. Application Data

(60) Provisional application No. 63/208,646, filed on Jun. 9, 2021, provisional application No. 63/136,400, filed
(Continued)

(51) Int. Cl.
*B65D 71/72* (2006.01)
*B65D 71/42* (2006.01)
(Continued)

(52) U.S. Cl.
CPC ..... *B65D 71/72* (2013.01); *B31B 50/262* (2017.08); *B65D 71/42* (2013.01); *B31B 50/20* (2017.08);
(Continued)

(58) Field of Classification Search
CPC ..... B31B 50/20; B31B 50/86; B31B 50/262; B31B 2100/00; B65D 71/40; B65D 71/42;
(Continued)

(56) References Cited

U.S. PATENT DOCUMENTS 1,527,399 A 2/1925 Davidson
2,289,859 A 7/1942 Arthur
(Continued)

FOREIGN PATENT DOCUMENTS

AT 399701 B 7/1995
CA 2133827 10/1993
(Continued)

OTHER PUBLICATIONS

U.S. Appl. No. 16/426,050, filed May 30, 2019.
(Continued)

*Primary Examiner* — Bryon P Gehman
(74) *Attorney, Agent, or Firm* — Womble Bond Dickinson (US) LLP

(57) ABSTRACT

A carrier for holding a plurality of containers includes a top panel comprising a plurality of container retention openings for at least partially receiving a respective container of the plurality of containers, at least one container retention flap foldably connected to the top panel, the top panel comprises at least one container retention tab positioned adjacent a respective container retention opening and foldably connected to the top panel at a respective fold line, at least one side reinforcement panel positioned between the top panel and the at least one container retention flap, and the top panel comprises at least one reinforcement portion extending from the respective fold line.

62 Claims, 6 Drawing Sheets

Related U.S. Application Data on Jan. 12, 2021, provisional application No. 63/120,863, filed on Dec. 3, 2020, provisional application No. 63/086,681, filed on Oct. 2, 2020, provisional application No. 63/085,365, filed on Sep. 30, 2020.

(51) Int. Cl.
*B31B 50/26* (2017.01)
*B31B 50/86* (2017.01)
*B31B 50/20* (2017.01)
*B31B 100/00* (2017.01)

(52) U.S. Cl.
CPC ..... *B31B 50/86* (2017.08); *B31B 2100/00* (2017.08); *B65D 2571/0029* (2013.01); *B65D 2571/0066* (2013.01); *B65D 2571/00141* (2013.01); *B65D 2571/00259* (2013.01); *B65D 2571/00444* (2013.01); *B65D 2571/00561* (2013.01)

(58) Field of Classification Search
CPC ..... B65D 71/46; B65D 71/72; B65D 75/00; B65D 2571/00141; B65D 2571/00259; B65D 2571/0029; B65D 2571/00444; B65D 2571/00561; B65D 2571/0066
USPC ..... 206/153, 427
See application file for complete search history.

(56) References Cited

U.S. PATENT DOCUMENTS 2,320,440 A 6/1943 Kruea
2,331,038 A 10/1943 Meller
2,397,376 A 3/1946 Caldwell
2,397,716 A 4/1946 Wendler
2,522,950 A 9/1950 Keith
2,594,376 A 4/1952 Arneson
2,594,377 A 4/1952 Arneson
2,737,326 A 3/1956 Toensmeier
2,798,603 A 7/1957 Grinspoon
2,950,041 A 8/1960 Stone
2,965,410 A 12/1960 Hughes
3,001,647 A 9/1961 Liss
3,046,711 A 7/1962 Harrison
3,061,141 A 10/1962 Cote
3,094,210 A 6/1963 Van Der Berg
3,099,475 A 7/1963 Manizza
3,118,537 A 1/1964 Copping
3,128,034 A 4/1964 Weiss
3,137,109 A 6/1964 Rapata
3,146,885 A 9/1964 Grantham
3,156,358 A 11/1964 Randrup
3,200,944 A 8/1965 Rapata
3,223,308 A 12/1965 Weiss
3,245,711 A 4/1966 Dantoin
3,257,066 A 6/1966 Williams
3,281,180 A 10/1966 Spery
3,302,784 A 2/1967 Copping
3,387,879 A 6/1968 Wood
3,404,912 A 10/1968 Watts
3,410,596 A 11/1968 Slevin, Jr.
3,432,202 A 3/1969 Ebelhardt
3,463,535 A 8/1969 Beart
3,528,697 A 9/1970 Wood
3,587,847 A 6/1971 Graser
3,601,439 A 8/1971 Pitch
3,612,266 A 10/1971 Graser
D222,579 S 11/1971 Oglesbee
3,627,121 A 12/1971 Deasy
3,653,503 A 4/1972 Arneson
3,693,787 A 9/1972 Duerr
3,698,550 A 10/1972 Graser
3,701,416 A 10/1972 Lawrence
3,722,945 A 3/1973 Wood
3,726,558 A 4/1973 Klygis
3,734,278 A 5/1973 Kerrigan
3,876,066 A 4/1975 Klygis
3,897,873 A 8/1975 Graser
3,924,739 A 12/1975 Gravesteijn
3,942,631 A 3/1976 Sutherland et al.
4,029,204 A 6/1977 Manizza
4,111,298 A 9/1978 Mascia
4,120,396 A 10/1978 Mascia
4,136,772 A 1/1979 Mascia
4,155,502 A 5/1979 Forte
4,190,149 A 2/1980 Oliff et al.
D257,001 S 9/1980 Oliff
4,244,617 A 1/1981 Manizza
4,304,329 A 12/1981 Graser
D265,292 S 7/1982 Killy
4,339,032 A 7/1982 Wood
D265,979 S 8/1982 Arfert
4,372,599 A 2/1983 Kiedaisch et al.
4,378,879 A 4/1983 Killy
4,382,505 A 5/1983 Sutherland et al.
4,441,611 A 4/1984 Sommariva
4,453,630 A 6/1984 Helms
4,471,870 A 9/1984 Uhlig
4,523,676 A 6/1985 Barrash
D294,331 S 2/1988 Panazzolo
4,784,266 A 11/1988 Chaussadas
D304,017 S 10/1989 Oliff
4,911,288 A 3/1990 Dantoin, Jr.
4,974,726 A 12/1990 Klygis et al.
5,002,225 A 3/1991 Bienaime
5,065,862 A 11/1991 Mousseau
5,103,971 A 4/1992 Schuster
5,125,506 A 6/1992 Galbierz et al.
5,135,104 A 8/1992 Jorba
5,139,147 A 8/1992 Sutherland
D329,807 S 9/1992 Heider
5,188,225 A 2/1993 Jorba
5,193,673 A 3/1993 Rathbone et al.
5,201,412 A 4/1993 Schuster et al.
5,230,425 A 7/1993 Edqvist et al.
5,246,113 A 9/1993 Schuster
5,263,299 A 11/1993 Galbierz et al.
5,267,644 A 12/1993 Tsao
5,282,348 A 2/1994 Dampier et al.
5,297,673 A 3/1994 Sutherland
5,310,050 A 5/1994 Sutherland
5,310,051 A 5/1994 Sutherland
5,314,224 A 5/1994 Bates
5,318,178 A 6/1994 Davies et al.
5,323,895 A 6/1994 Sutherland et al.
5,328,024 A 7/1994 Sutherland
5,335,774 A 8/1994 Ganz
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,425,446 A 6/1995 Weaver
5,443,153 A 8/1995 Sutherland
5,445,262 A 8/1995 Sutherland
5,452,799 A 9/1995 Sutherland
5,484,053 A 1/1996 Harris
5,485,914 A 1/1996 Martin
5,487,464 A 1/1996 Galbierz et al.
5,490,593 A 2/1996 Gordon et al.
5,503,267 A 4/1996 Sutherland
5,520,283 A 5/1996 Sutherland
5,524,756 A 6/1996 Sutherland
5,551,566 A 9/1996 Sutherland
5,553,704 A 9/1996 Gordon et al.
5,553,705 A 9/1996 Bakx
5,573,111 A * 11/1996 Gordon ..... B65D 71/42 206/151
5,590,776 A 1/1997 Galbierz
5,593,027 A 1/1997 Sutherland

(56) References Cited

U.S. PATENT DOCUMENTS

| | | | | |
|---|---|---|---|---|
| 5,609,247 | A | 3/1997 | Appleton | |
| 5,609,251 | A | 3/1997 | Harris | |
| 5,609,379 | A | 3/1997 | Harrelson | |
| 5,639,137 | A | 6/1997 | Bakx | |
| 5,682,982 | A | 11/1997 | Stonehouse | |
| 5,706,936 | A | 1/1998 | Bernstein | |
| 5,711,419 | A | 1/1998 | Beales et al. | |
| 5,735,394 | A | 4/1998 | Harrelson | |
| 5,746,310 | A | 5/1998 | Slomski | |
| 5,762,193 | A | 6/1998 | Marco | |
| 5,791,463 | A | 8/1998 | Negelen | |
| 5,816,391 | A | 10/1998 | Harris | |
| 5,845,776 | A | 12/1998 | Galbierz et al. | |
| 5,878,876 | A | 3/1999 | Galbierz et al. | |
| 5,960,945 | A | 10/1999 | Sutherland | |
| 6,039,181 | A | 3/2000 | Whiteside | |
| 6,059,099 | A | 5/2000 | Galbierz | |
| 6,082,532 | A | 7/2000 | Miess | |
| 6,145,656 | A | 11/2000 | Marco | |
| 6,168,012 | B1 * | 1/2001 | Galbierz ..... | B65D 71/46 206/153 |
| 6,293,392 | B1 | 9/2001 | Galbierz | |
| 6,315,111 | B1 | 11/2001 | Sutherland | |
| 6,394,272 | B1 | 5/2002 | Domansky | |
| 6,896,130 | B2 | 5/2005 | Theelen | |
| D506,925 | S | 7/2005 | Plumer | |
| 7,011,209 | B2 | 3/2006 | Sutherland et al. | |
| 7,690,507 | B2 | 4/2010 | Sutherland | |
| 7,721,878 | B2 | 5/2010 | Requena | |
| 7,762,397 | B2 | 7/2010 | Coltri-Johnson et al. | |
| 7,789,231 | B2 | 9/2010 | Requena | |
| 7,823,721 | B2 | 11/2010 | Sutherland et al. | |
| 8,056,709 | B2 | 11/2011 | Sutherland | |
| 8,096,413 | B2 | 1/2012 | DePaula | |
| 8,162,135 | B2 | 4/2012 | Oliveira | |
| 8,353,398 | B2 | 1/2013 | DePaula et al. | |
| 8,387,784 | B2 | 3/2013 | Gonzalez et al. | |
| 8,443,968 | B2 | 5/2013 | DePaula | |
| 8,464,866 | B2 | 6/2013 | Sutherland et al. | |
| 8,469,184 | B2 | 6/2013 | Spivey, Sr. | |
| 8,602,209 | B2 | 12/2013 | Jones et al. | |
| 8,631,932 | B2 | 1/2014 | Holley, Jr. | |
| 8,701,878 | B2 | 4/2014 | Spivey, Sr. | |
| 8,925,720 | B2 | 1/2015 | Sutherland et al. | |
| 8,936,149 | B2 | 1/2015 | Smalley | |
| 8,955,674 | B2 | 2/2015 | Spivey, Sr. et al. | |
| 9,079,699 | B2 | 7/2015 | Holley, Jr. | |
| 9,169,050 | B2 | 10/2015 | Spivey, Sr. | |
| 9,284,090 | B2 | 3/2016 | Lettre | |
| 9,359,093 | B2 | 6/2016 | DePaula et al. | |
| 9,376,250 | B2 | 6/2016 | Spivey, Sr. | |
| D767,408 | S | 9/2016 | Shuster | |
| 9,446,891 | B2 | 9/2016 | Jones et al. | |
| 9,511,916 | B2 | 12/2016 | Holley, Jr. | |
| 9,669,976 | B2 | 6/2017 | Kastanek et al. | |
| 9,676,535 | B2 | 6/2017 | Spivey, Sr. | |
| 10,077,131 | B2 | 9/2018 | Lettre | |
| D881,021 | S | 4/2020 | Bandinu | |
| D881,718 | S | 4/2020 | Bandinu | |
| 10,836,550 | B2 | 11/2020 | Zacherle | |
| D918,057 | S | 5/2021 | L'Heureux | |
| D918,058 | S | 5/2021 | L'Heureux | |
| 11,014,727 | B2 | 5/2021 | McCree | |
| D920,809 | S | 6/2021 | Chesnet et al. | |
| D921,493 | S | 6/2021 | Chesnet | |
| D923,416 | S | 6/2021 | Luciano | |
| 11,027,905 | B2 | 6/2021 | Ford | |
| 11,180,301 | B2 | 11/2021 | Smalley | |
| D944,656 | S | 3/2022 | Spivey, Sr. | |
| D946,416 | S | 3/2022 | Smalley | |
| D946,417 | S | 3/2022 | Gonzalez Manzano | |
| D946,418 | S | 3/2022 | Gonzalez Manzano | |
| D946,419 | S | 3/2022 | Gonzalez Manzano | |
| D946,420 | S | 3/2022 | Gonzalez Manzano | |
| D946,421 | S | 3/2022 | Gonzalez Manzano | |
| 11,261,013 | B2 | 3/2022 | Smalley | |
| 11,286,094 | B2 | 3/2022 | Gonzalez Manzano | |
| D955,889 | S | 6/2022 | Gonzalez Manzano | |
| D955,890 | S | 6/2022 | Gonzalez Manzano | |
| D956,574 | S | 7/2022 | Gonzalez Manzano | |
| 11,401,095 | B2 | 8/2022 | Rosenbrien | |
| 11,420,802 | B2 | 8/2022 | Kooc | |
| D962,789 | S | 9/2022 | Noel | |
| 2002/0195371 | A1 | 12/2002 | Brown | |
| 2003/0080004 | A1 | 5/2003 | Olsen et al. | |
| 2003/0213705 | A1 | 11/2003 | Woog | |
| 2004/0206639 | A1 | 10/2004 | Karlsson | |
| 2004/0211695 | A1 | 10/2004 | Karlsson | |
| 2004/0226833 | A1 | 11/2004 | Daniel | |
| 2005/0127151 | A1 | 6/2005 | Johnson | |
| 2005/0199513 | A1 | 9/2005 | Bakx et al. | |
| 2006/0255114 | A1 | 11/2006 | Hand et al. | |
| 2007/0080084 | A1 | 4/2007 | Sutherland | |
| 2007/0163908 | A1 | 7/2007 | Sutherland | |
| 2009/0101526 | A1 | 4/2009 | Sutherland et al. | |
| 2009/0127147 | A1 | 5/2009 | Sutherland | |
| 2010/0078337 | A1 | 4/2010 | Sutherland et al. | |
| 2010/0264043 | A1 | 10/2010 | DePaula | |
| 2011/0000799 | A1 | 1/2011 | Gonzalez | |
| 2012/0138489 | A1 | 6/2012 | Holley, Jr. | |
| 2015/0191287 | A1 | 7/2015 | L'Heureux et al. | |
| 2016/0325899 | A1 | 11/2016 | L'Heureux et al. | |
| 2018/0111734 | A1 | 4/2018 | Jego | |
| 2018/0222650 | A1 | 8/2018 | Zacherle | |
| 2018/0362234 | A1 | 12/2018 | L'Heureux et al. | |
| 2019/0119019 | A1 | 4/2019 | Patton | |
| 2020/0010255 | A1 | 1/2020 | Zacherle et al. | |
| 2020/0079564 | A1 | 3/2020 | Ford | |
| 2020/0189817 | A1 | 6/2020 | Smalley | |
| 2020/0189818 | A1 | 6/2020 | McCree | |
| 2020/0189819 | A1 | 6/2020 | McCree | |
| 2020/0189821 | A1 | 6/2020 | Smalley | |
| 2020/0189822 | A1 | 6/2020 | Smalley | |
| 2020/0223612 | A1 | 7/2020 | Swenson | |
| 2021/0061502 | A1 | 3/2021 | Johnston | |
| 2021/0094742 | A1 | 4/2021 | Gonzalez Manzano | |
| 2021/0276776 | A1 | 9/2021 | Zammit | |
| 2021/0316921 | A1 | 10/2021 | Holtz | |
| 2021/0331847 | A1 | 10/2021 | Gonzalez Manzano | |
| 2021/0331848 | A1 | 10/2021 | Gonzalez Manzano | |
| 2021/0339928 | A1 | 11/2021 | Blin | |
| 2022/0009685 | A1 | 1/2022 | Thompson | |
| 2022/0097941 | A1 | 3/2022 | McCree | |

FOREIGN PATENT DOCUMENTS

| | | | |
|---|---|---|---|
| DE | 298 13 672 | U1 | 11/1998 |
| DE | 203 19 247 | U1 | 5/2004 |
| DE | 10 2009 059 047 | A1 | 6/2011 |
| EP | 0 051 413 | A1 | 5/1982 |
| EP | 0 060 504 | A2 | 9/1982 |
| EP | 0 057 437 | B1 | 5/1985 |
| EP | 0 496 807 | | 6/1993 |
| EP | 0 636 096 | | 2/1995 |
| EP | 0 715 593 | A1 | 6/1996 |
| EP | 0 398 835 | B1 | 10/1996 |
| EP | 2 067 713 | A1 | 6/2009 |
| EP | 1 528 007 | B1 | 10/2010 |
| EP | 2739547 | B1 | 7/2017 |
| EP | 3 666 684 | A1 | 6/2020 |
| EP | 3 666 685 | A1 | 6/2020 |
| FR | 2 737 196 | A1 | 1/1997 |
| GB | 1 256 684 | | 12/1971 |
| GB | 2 321 229 | A | 7/1998 |
| GB | 9006736716 | | 8/2019 |
| GB | 2591535 | A | 8/2021 |
| GB | 6161591 | | 9/2021 |
| JP | 10-297668 | A | 11/1998 |
| JP | 2001-519300 | A | 10/2001 |
| JP | 2003-146359 | | 5/2003 |
| JP | 2004-189243 | A | 7/2004 |
| JP | 2015-048088 | A | 3/2015 |
| KR | 10-2005-0051616 | A | 6/2005 |
| KR | 10-2020-0106806 | A | 9/2020 |

(56) References Cited

FOREIGN PATENT DOCUMENTS

| | | | |
|---|---|---|---|
| KR | 301130233 | | 10/2021 |
| WO | WO 93/02941 | | 2/1993 |
| WO | WO 93/21083 | | 10/1993 |
| WO | WO 93/25439 | A1 | 12/1993 |
| WO | WO 94/22738 | A1 | 10/1994 |
| WO | WO 95/01289 | A1 | 1/1995 |
| WO | WO 95/06604 | | 3/1995 |
| WO | WO 96/26128 | A1 | 8/1996 |
| WO | WO 96/32340 | A1 | 10/1996 |
| WO | WO 2008/058294 | A1 | 5/2008 |
| WO | WO 2010/006629 | A1 | 1/2010 |
| WO | WO 2010/101852 | A1 | 9/2010 |
| WO | WO 2021/168417 | A1 | 8/2021 |
| WO | WO 2021/188751 | A1 | 9/2021 |
| WO | WO 2021/262858 | A1 | 12/2021 |

OTHER PUBLICATIONS

U.S. Appl. No. 16/426,057, filed May 30, 2019.
U.S. Appl. No. 16/426,060, filed May 30, 2019.
U.S. Appl. No. 16/426,063, filed May 30, 2019.
U.S. Appl. No. 16/426,066, filed May 30, 2019.
U.S. Appl. No. 29/692,992, filed May 30, 2019.
U.S. Appl. No. 29/692,993, filed May 30, 2019.
U.S. Appl. No. 29/692,994, filed May 30, 2019.
U.S. Appl. No. 29/692,996, filed May 30, 2019.
U.S. Appl. No. 29/692,997, filed May 30, 2019.
U.S. Appl. No. 16/598,282, filed Oct. 10, 2019.
U.S. Appl. No. 29/709,918, filed Oct. 18, 2019.
U.S. Appl. No. 16/829,346, filed Mar. 25, 2020.
U.S. Appl. No. 29/735,178, filed May 19, 2020.
U.S. Appl. No. 16/937,043, filed Jul. 23, 2020.
U.S. Appl. No. 29/739,927, filed Jun. 30, 2020.
U.S. Appl. No. 29/739,929, filed Jun. 30, 2020.
U.S. Appl. No. 29/739,931, filed Jun. 30, 2020.
U.S. Appl. No. 29/739,933, filed Jun. 30, 2020.
U.S. Appl. No. 29/739,934, filed Jun. 30, 2020.
U.S. Appl. No. 17/118,999, filed Dec. 11, 2020.
U.S. Appl. No. 17/119,016, filed Dec. 11, 2020.
U.S. Appl. No. 17/119,040, filed Dec. 11, 2020.
U.S. Appl. No. 16/562,957, filed Sep. 6, 2019.
U.S. Appl. No. 17/036,775, filed Sep. 29, 2020.
U.S. Appl. No. 17/231,368, filed Apr. 15, 2021.
U.S. Appl. No. 17/245,583, filed Apr. 30, 2021.
U.S. Appl. No. 17/478,025, filed Sep. 17, 2021.
U.S. Appl. No. 17/487,131, filed Sep. 28, 2021.
U.S. Appl. No. 17/487,262, filed Sep. 28, 2021.
U.S. Appl. No. 17/487,141, filed Sep. 28, 2021.
U.S. Appl. No. 29/775,557, filed Mar. 24, 2021.
U.S. Appl. No. 29/775,558, filed Mar. 24, 2021.
U.S. Appl. No. 29/775,559, filed Mar. 24, 2021.
U.S. Appl. No. 29/775,560, filed Mar. 24, 2021.
U.S. Appl. No. 29/818,355, filed Dec. 8, 2021.
U.S. Appl. No. 29/819,435, filed Dec. 15, 2021.
U.S. Appl. No. 29/819,437, filed Dec. 15, 2021.
U.S. Appl. No. 29/819,438, filed Dec. 15, 2021.
U.S. Appl. No. 29/819,440, filed Dec. 15, 2021; and.
U.S. Appl. No. 17/573,911, filed Jan. 12, 2022.
"Florida brewery unveils six-pack rings that spare sea turtles, not snare them," by Thomas Leavy, CBSNews.com. Date posted: May 24, 2018. Site visited: Sep. 12, 2022. Available online: https://www.cbsnews.com/news/ florida-saltwater-brewery-non-plastic-six-pack-rings-spare-sea-turtles/ (Year: 2018).
"Pepsi trials molded pulp alternative to plastic rings" in BeverageDaily.com. Date posted: Feb. 28, 2020. Site visited: Sep. 12, 2022. Available online: https://www.beveragedaily.com/Article/2020/02/28/Pepsi-trials-molded-pulp-alternative-to-plastic-rings# (Year: 2020).
Enviroclip. Date posted: 2022. Site visited: Sep. 12, 2022. Available online: https://www.graphicpkg.com/products/enviroclip/ (Year: 2022).
"Paperboard Can Handle Applicator," as seen in Packaging World Online. Date first available: 2020. Site visited: Sep. 13, 2022. Available online: https://www.packworld.com/news/sustainability/article/21202650/paperboard-can-handle-applicator (Year: 2020).
"The 'ECOGRIP' Corrugated Bottle Carrier is a Plastic Alternative" in Trendhunter.com. Date published: Jan. 20, 2021. Site visited: Sep. 12, 2022. Available online: https://www.trendhunter.com/trends/corrugated-bottle-carrier (Year: 2021).
Cap-it packaging video on Vimeo. Date posted: 2021. Site visited: Sep. 19, 2022. Available online: https://vimeo.com/610619455?embedded=true&source=vimeo_logo&owner=24551687 (Year: 2021).
2020 Package of the Year and Innovation of the Year on YouTube. Date posted: Oct. 19, 2020. Site visited: Sep. 12, 2022. Available online: https://www.youtube.com/watch?v=wxwpM4hodFA (Year: 2020).

* cited by examiner

CARRIER FOR CONTAINERS

CROSS-REFERENCE TO RELATED APPLICATIONS

This application claims the benefit of each of U.S. Provisional Patent Application No. 63/085,365, filed on Sep. 30, 2020, U.S. Provisional Patent Application No. 63/086,681, filed on Oct. 2, 2020, U.S. Provisional Patent Application No. 63/120,863, filed on Dec. 3, 2020, U.S. Provisional Patent Application No. 63/136,400, filed on Jan. 12, 2021, and U.S. Provisional Patent Application No. 63/208,646, filed on Jun. 9, 2021.

INCORPORATION BY REFERENCE

The disclosures of each of U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, U.S. Provisional Patent Application No. 62/84630227571,449, filed on May 1, 2019, U.S. patent application Ser. No. 16/426,050, filed on May 30, 2019, U.S. patent application Ser. No. 16/426,057, filed on May 30, 2019, U.S. patent application Ser. No. 16/426,060, filed on May 30, 2019, U.S. patent application Ser. No. 16/426,063, filed on May 30, 2019, U.S. patent application Ser. No. 16/426,066, filed on May 30, 2019, U.S. Design patent application No. 29/692,992, filed on May 30, 2019, U.S. Design patent application No. 29/692,993, filed on May 30, 2019, U.S. Design patent application No. 29/692,994, filed on May 30, 2019, U.S. Design patent application No. 29/692,996, filed on May 30, 2019, U.S. Design patent application No. 29/692,997, filed on May 30, 2019, U.S. patent application Ser. No. 16/598,282, filed on Oct. 10, 2019, U.S. Design patent Application No. 29/709,918, filed on Oct. 18, 2019, U.S. Provisional Patent Application No. 62/952,839, filed on Dec. 23, 2019, U.S. Provisional Patent Application No. 62/956,882, filed on Jan. 3, 2020, U.S. Provisional Patent Application No. 62/985,997, filed on Mar. 6, 2020, U.S. patent application Ser. No. 16/829,346, filed on Mar. 25, 2020, and U.S. Provisional Patent Application No. 63/015,898, filed on Apr. 27, 2020, U.S. Provisional Patent Application No. 63/022,757, filed on May 11, 2020, U.S. Provisional Patent Application No. 63/023,442, filed on May 12, 2020, U.S. Design patent application No. 29/735,178, filed on May 19, 2020, U.S. Provisional Patent Application No. 63/031,615, filed on May 29, 2020, U.S. Design patent application No. 29/739,927, filed on Jun. 30, 2020, U.S. Design patent application No. 29/739,929, filed on Jun. 30, 2020, U.S. Design patent application No. 29/739,931, filed on Jun. 30, 2020, U.S. Design patent application No. 29/739,933, filed on Jun. 30, 2020, U.S. Design patent Application No. 29/739,934, filed on Jun. 30, 2020, U.S. Provisional Patent Application No. 63/085,365, filed on Sep. 30, 2020, U.S. Provisional Patent Application No. 63/086,681, filed on Oct. 2, 2020, U.S. Provisional Patent Application No. 63/120,863, filed on Dec. 3, 2020, U.S. patent application Ser. No. 17/119,040, filed on Dec. 11, 2020, U.S. patent application Ser. No. 17/118,999, filed on Dec. 11, 2020, U.S. Provisional Patent Application No. 63/136,400, filed on Jan. 12, 2021, U.S. Design patent application No. 29/775,557, filed on Mar. 24, 2021, U.S. Design patent application No. 29/775,558, filed on Mar. 24, 2021, U.S. Design patent application No. 29/775,559, filed on Mar. 24, 2021, U.S. Design patent application No. 29/775,560, filed on Mar. 24, 2021, U.S. Provisional Patent Application No. 63/208,568, filed on Jun. 9, 2021, and U.S. Provisional Patent Application No. 63/208,646, filed on Jun. 9, 2021, U.S. Provisional Application No. 62/728,454, filed on Sep. 7, 2018, U.S. Provisional Patent Application No. 62/767,188, filed on Nov. 14, 2018, U.S. Provisional Patent Application No. 62/770,566, filed on Nov. 21, 2018, and U.S. Provisional Patent Application No. 63/214,868, filed on Jun. 25, 2021, U.S. Provisional Patent Application No. 63/216,062, filed on Jun. 29, 2021, and U.S. Provisional Patent Application No. 63/219,648, file d on Jul. 8, 2021, U.S. Provisional Patent Application No. 63/222,225, filed on Jul. 15, 2021, U.S. Provisional Patent Application No. 63/203,882, filed on Aug. 3, 2021, U.S. Provisional Patent Application No. 63/260,881, filed on Sep. 3, 2021, and U.S. Provisional Patent Application No. 63/261,582, filed on Sep. 24, 2021, are hereby incorporated by reference for all purposes as if presented herein in their entirety. The disclosures of each of U.S. Pat. No. 8,387,784, issued on Mar. 5, 2013, U.S. Pat. No. 8,096,413, issued on Jan. 17, 2012, and U.S. Pat. No. 11,027,905, issued on Jun. 8, 2021, are also hereby incorporated by reference for all purposes as if presented herein in their entirety.

BACKGROUND OF THE DISCLOSURE

The present disclosure generally relates to cartons or carriers for holding, displaying, and/or transporting containers.

SUMMARY OF THE DISCLOSURE

According to one aspect, the disclosure is generally directed to a carrier for holding a plurality of containers, the carrier comprising a top panel comprising a plurality of container retention openings for at least partially receiving a respective container of the plurality of containers, at least one container retention flap foldably connected to the top panel, the top panel comprises at least one container retention tab positioned adjacent a respective container retention opening and foldably connected to the top panel at a respective fold line, at least one side reinforcement panel positioned between the top panel and the at least one container retention flap, and the top panel comprises at least one reinforcement portion extending from the respective fold line.

According to another aspect, the disclosure is generally directed to a blank for forming a carrier for holding a plurality of containers, the blank comprising atop panel comprising a plurality of container retention openings for at least partially receiving a respective container of the plurality of containers when the carrier is formed from the blank, at least one container retention flap foldably connected to the top panel, the top panel comprises at least one container retention tab positioned adjacent a respective container retention opening and foldably connected to the top panel at a respective fold line, at least one side reinforcement panel positioned between the top panel and the at least one container retention flap, and the top panel comprises at least one reinforcement portion extending from the respective fold line.

According to another aspect, the disclosure is generally directed to a method of forming a carrier for holding a plurality of containers, the method comprising obtaining a blank comprising a top panel comprising a plurality of container retention openings, at least one container retention flap foldably connected to the top panel, the top panel comprises at least one container retention tab positioned adjacent a respective container retention opening and foldably connected to the top panel at a respective fold line, at least one side reinforcement panel positioned between the top panel and the at least one container retention flap, the top panel comprises at least one reinforcement portion extending from the respective fold line. The method further comprises positioning the blank such that the plurality of container retention openings is positioned for at least partially receiving a respective container of the plurality of containers.

According to another aspect, the disclosure is generally directed to a package, the package comprising a plurality of containers and a carrier holding the plurality of containers. The carrier comprises a top panel comprising a plurality of container retention openings at least partially receiving a respective container of the plurality of containers, at least one container retention flap foldably connected to the top panel, the top panel comprises at least one container retention tab positioned adjacent a respective container retention opening and foldably connected to the top panel at a respective fold line, at least one side reinforcement panel positioned between the top panel and the at least one container retention flap, and the top panel comprises at least one reinforcement portion extending from the respective fold line.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., aluminum cans) at least partially disposed within the carrier embodiments. In this specification, the terms "lower," "bottom," "upper," "top," "front," and "back" indicate orientations determined in relation to fully erected carriers.

As described herein, carriers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
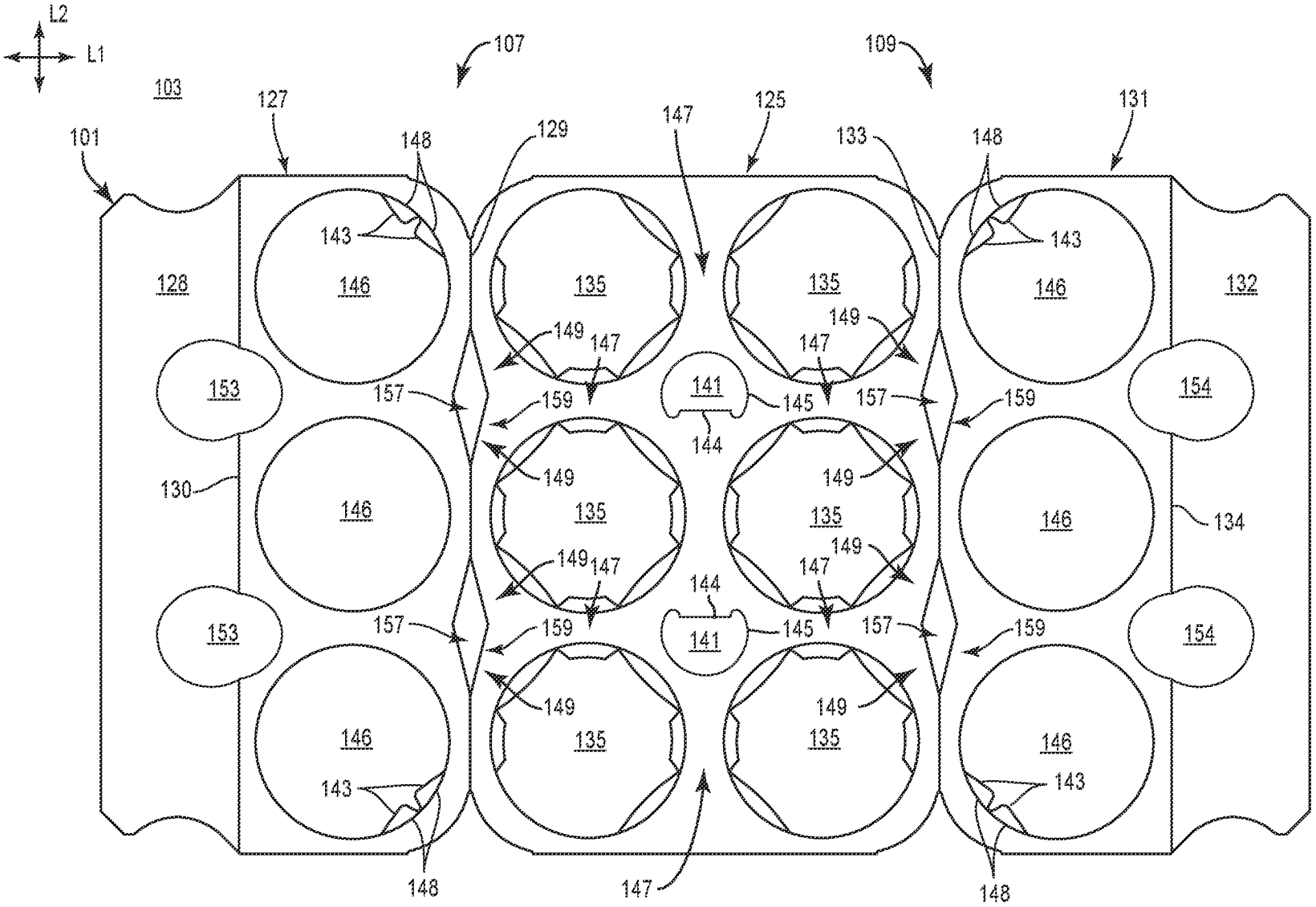
FIG. 1 is a plan view of an outer surface of a blank for forming a carrier according to a first exemplary embodiment of the disclosure.
Figure 2:
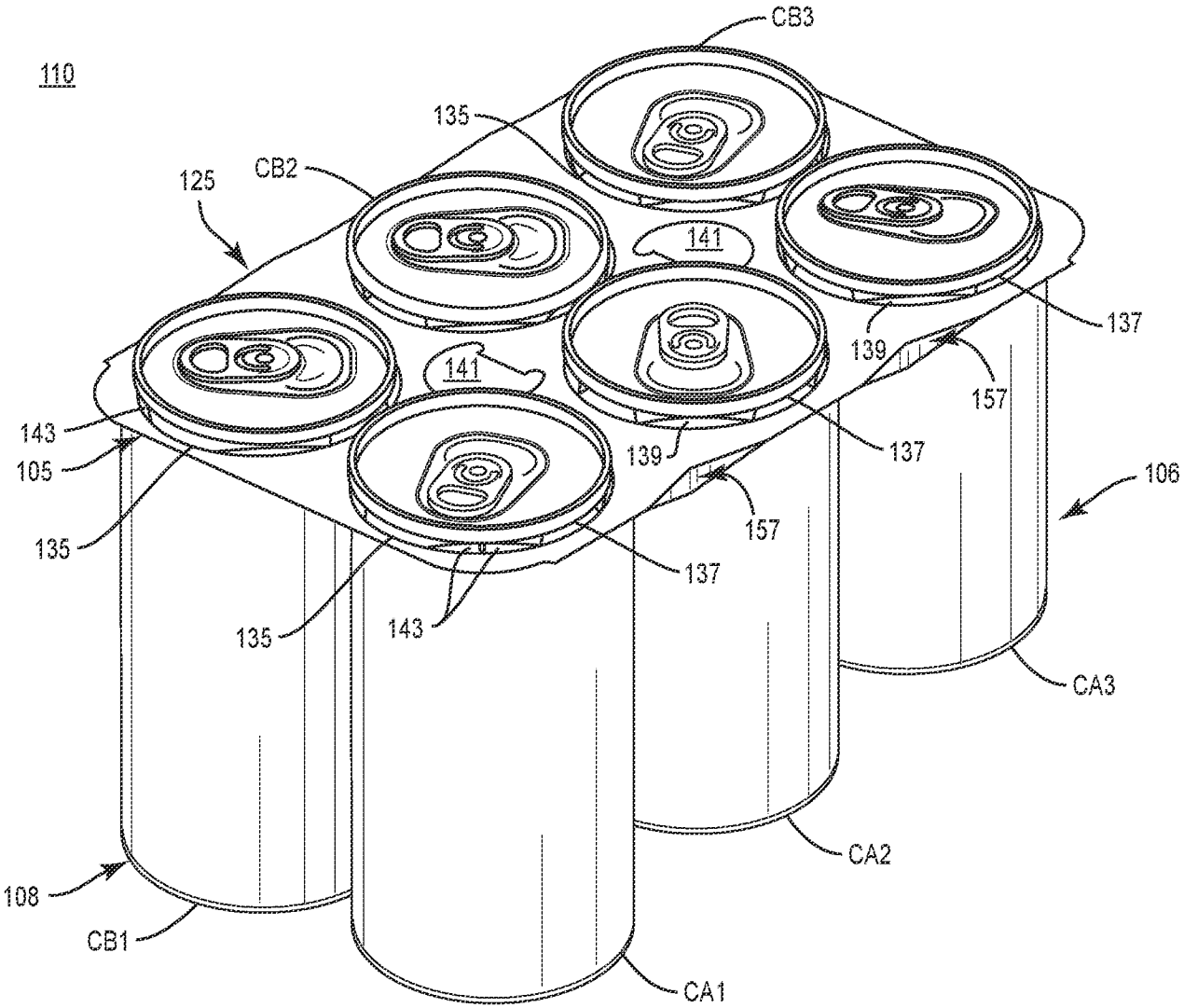
FIG. 2 is perspective view of a package including a carrier formed from the blank of FIG. 1 and a plurality of containers according to the first exemplary embodiment of the disclosure.

FIG. 1 shows a plan view of an exterior side 101 of a blank 103 used to form a carrier 105 (FIG. 2) in accordance with a first exemplary embodiment of the disclosure. As described further herein, the carrier 105 can be configured for holding/supporting/retaining/receiving a plurality of containers. The carrier 105 can be provided with one or more containers to form a package 110 (FIG. 2).

Containers suitable for use with the carriers of the present disclosure can be beverage cans having a lower base portion, a top portion T generally comprising a neck that tapers inwardly from the lower base portion, a flange portion at the top of the neck portion that extends radially outward from the neck portion, and a top surface below the flange portion that includes a pull-tab. Containers of other sizes, shapes, and configurations, may be held in the carriers without departing from the disclosure.

Still referring to FIG. 1, the carrier 105 can be sized to contain or support six containers, with three containers CA1, CA2, CA3 being attached to a front portion 106 of the carrier 105 and three containers CB1, CB2, CB3 being attached to a back portion 108 of the carrier 105. In the illustrated embodiment, the containers CA1, CA2, CA3, CB1, CB2, CB3 can be beverage cans, or could be any other suitable type and size of container without departing from the disclosure. The carrier 105 can be provided together with one or more of the containers as a package 110.

The carrier 105 can be sized and shaped to hold more or less than six containers. In one embodiment, the front portion 106 and the back portion 108 of the carrier 105 each have three containers, and in other embodiments, the front portion 106 and the back portion 108 of the carrier 105 can carry more or less than three containers without departing from the disclosure.

As shown in FIG. 1, the blank 103 has a longitudinal axis L1 and a lateral axis L2. The blank 103 has a front portion 107 for forming the front portion 106 of the carrier 105 and a back portion 109 for forming the back portion 108 of the carrier 105.

In the illustrated embodiment, the blank 103 comprises a top panel 125 (broadly, "first top panel" or "central panel" or "attachment panel"), a container retention flap 127 (broadly, "first container retention flap", "first top end flap", "second top panel", or "first container retention panel") foldably connected to the top panel 125 at a lateral fold line 129 (broadly, "first fold line"), and a container retention flap 131 (broadly, "second container retention flap", "second top flap", "third top panel", or "second container retention panel") foldably connected to the top panel 125 at a lateral fold line 133 (broadly, "second fold line").

Figure 1A:
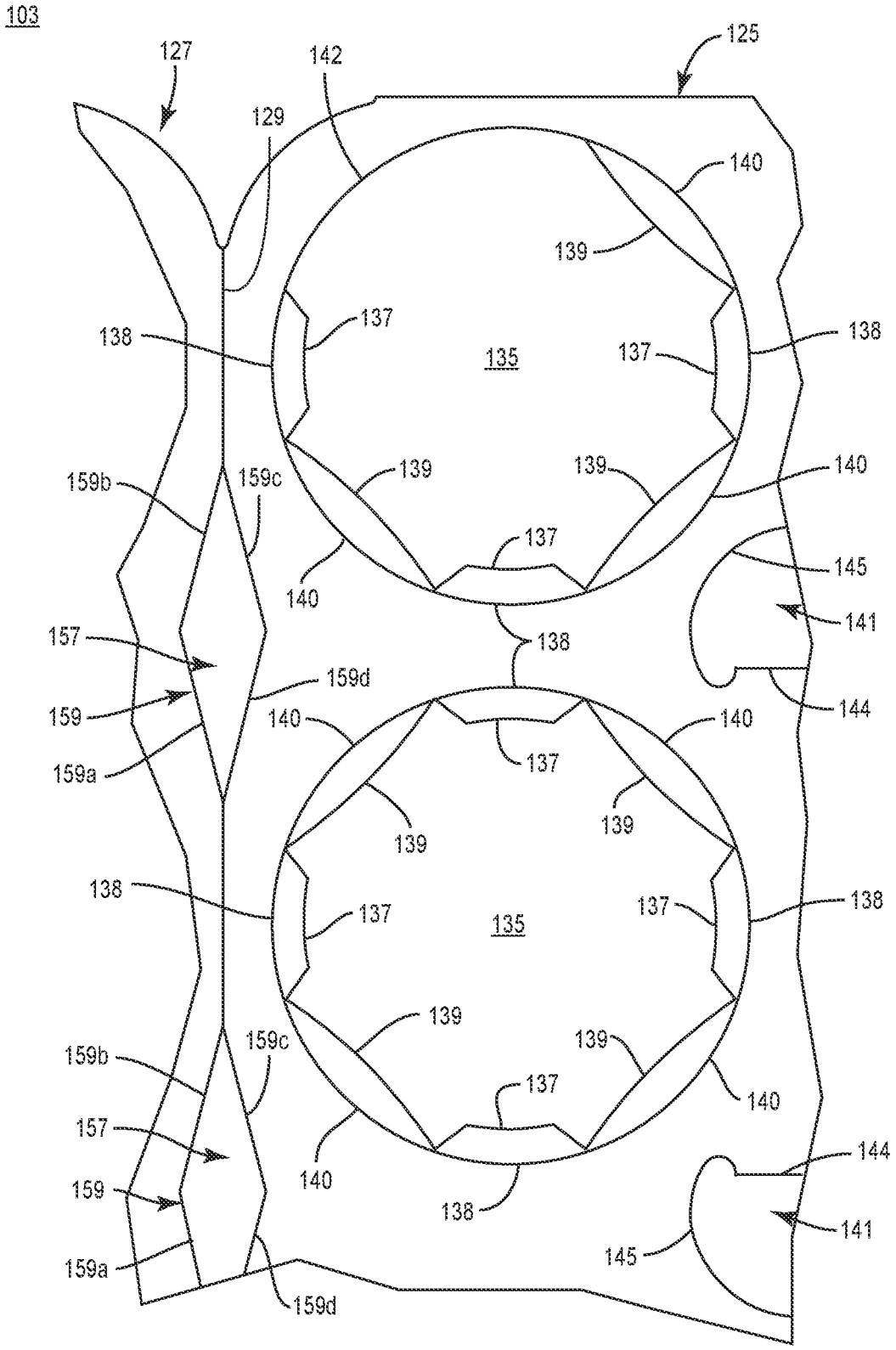
FIG. 1A is an enlarged view of a portion of the blank of FIG. 1.

With additional reference to FIG. 1A, the top panel 125 can have container retention features that include a plurality of container retention openings 135 (broadly, "first plurality of container retention openings"). As shown, the container retention openings 135 can be provided in a column and row arrangement in a number that corresponds to a desired number of containers to be held by the carrier 105 formed from the blank 103. In this regard, a selected container retention opening 135 can be considered a first retention opening, and a longitudinally or laterally adjacent container retention opening 135 can be considered a second container retention opening. While the top panel 125 is shown having container retention openings 135 provided in two rows/columns of three openings 135 each, it will be understood that a different number and/or arrangement of container retention openings 135 can be provided without departing from the disclosure.

As shown in FIG. 1A, the container retention openings 135 can have a generally circular configuration, with container retention tabs 137, 139 (broadly, "first container retention tab" and "second container retention tab", respectively) provided in an alternating arrangement foldably connected to the top panel 125 at respective curved fold lines 138, 140 (broadly, "first curved fold line" and "second curved fold line", respectively). In the illustrated arrangement, a pair of diametrically opposed container retention tabs 137 are provided/aligned along a line parallel with the longitudinal axis L1, a pair of diametrically opposed container retention tabs 137 are provided/aligned along a line parallel with the lateral axis L2, and container retention tabs 139 are provided/aligned between respective adjacent container retention tabs 137 at respective oblique angles relative to the axes L1, L2 defined by the blank 103/top panel 125. It will be understood that the container retention tabs 137, 139 can be provided in a generally abutting circumferential arrangement, though spacing could be provided between adjacent container retention tabs without departing from the disclosure. For example, in one embodiment, one or more of the container retention tabs 137, 139 can be at respective portions of a curved fold line/line of weakening that is longer than a respective individual curved fold line 138, 140.

While the container retention tabs 137, 139 are illustrated as having generally curved free edges facing the interior of the container retention opening 135, and with the container retention tabs 137 larger than the container retention tabs 139, it will be understood that one or more of the container retention tabs 137, 139 can have a different configuration or arrangement without departing from the disclosure.

The blank 103/carrier 105 can also have handle features that include at least one handle tab 141 foldably connected to the top panel 125 at a longitudinal fold line 144 and at least partially defined by a curved cut 145 extending from one endpoint of the fold line 144 to the other endpoint of the fold line 144. As described further herein, the handle tabs 141 can be separated from the top panel 125 to form respective handle openings for user engagement of the carrier 105.

Still referring to FIG. 1, each of the container retention flaps 127, 131 includes respective container retention openings 146 (broadly, "second plurality of container retention openings"). The container retention openings 146 are for being aligned with the respective container retention openings 135 when the carrier 105 is formed from the blank 103, as described further herein. While the container retention openings 146 are illustrated as generally symmetrical circular apertures, it will be understood that one or more of the container retention openings 146 can have a different configuration without departing from the disclosure, e.g., having multiple foci and/or asymmetrical portions, etc.

A respective pair of container retention tabs 143 can be foldably connected to the respective container retention flaps 127, 131 at respective curved fold lines 145 and can be positioned extending toward the center of the respective container retention openings 146. As described further herein, the container retention openings 146 are for being aligned with the respective container retention openings 135 when the carrier 105 is formed from the blank 103 and such that the respective container retention tabs 143 are aligned with the respective curved free edge portions 144 of the respective container retention openings 135 along which none of the container retention tabs 137, 139 are attached, as described further herein.

With continued reference to FIG. 1, the blank 103 includes a first reinforcement flap 128 (broadly, "first central panel" or "first keel") foldably connected to the container retention flap 127 at a lateral fold line 130 and a second reinforcement flap 132 (broadly, "second central panel" or "second keel") foldably connected to the container retention flap 131 at a lateral fold line 134.

Furthermore, the handle features of the blank 103/carrier 105 can include handle apertures 153, 154 that interrupt the respective fold lines 130, 134 and are for at least partially aligning with the respective handle tabs 141 when the carrier 105 is formed from the blank 103. The blank 103/carrier 105 can have one or more different handle features without departing from the disclosure.

With continued reference to FIG. 1, the blank 103/carrier 105 formed therefrom can be configured to stiffen/inhibit relative movement of portions of the blank 103/carrier 105 when in use. As shown, a pair of laterally-spaced reinforcement panels 157 (broadly, "first reinforcement features" or "side reinforcement features" or "first reinforcement panels" or "side reinforcement panels") can be positioned interrupting the fold line 129. Each reinforcement feature 157, as shown, can be a region of the blank 103/carrier 105 between the top panel 125 and the container retention flap 127 and that is defined by a line of weakening 159 extending between endpoints of segments of the fold line 129.

The line of weakening 159, as shown, can include a plurality of intersecting oblique segments 159*a*, 159*b*, 159*c*, 159*d*. In the illustrated embodiment, each of the segments 159*a*, 159*b*, 159*c*, 159*d* can be arranged so as to form a generally rhomboid/diamond-shaped reinforcement feature 157. In one embodiment, each of the segments 159*a*, 159*b*, 159*c*, 159*d* of the line of weakening 159 can be arranged at an angle of about 45° relative to each of the axes L1, L2. It will be understood that one or more of the lines of weakening 159/reinforcement features 157 can have one or more different features, e.g., curved and/or longitudinal/lateral portions, without departing from the disclosure.

As shown, a pair of longitudinally-spaced reinforcement panels 157 (broadly, "second reinforcement features" or "side reinforcement features" or "second reinforcement panels" or "side reinforcement panels") can also be provided interrupting the fold line 133 so as to be positioned between the top panel 125 and the container retention flap 131. It will be understood that a different number and/or arrangement of the reinforcement features 157 can be provided without departing from the disclosure.

In addition, the blank 103/carrier 105 can include inner reinforcement portions 147 (broadly, "second reinforcement features" or "third reinforcement features" or "fourth reinforcement features" or "first reinforcement portions" or "second reinforcement portions") and outer reinforcement portions 149 (broadly, "second reinforcement features" or "third reinforcement features" or "fourth reinforcement features" or "first reinforcement portions" or "second reinforcement portions") defined along/positioned in at least the top panel 125. In this regard, the reinforcement portions 147, 149 can be considered upper reinforcement features of the blank 103/carrier 105.

Figure 4:
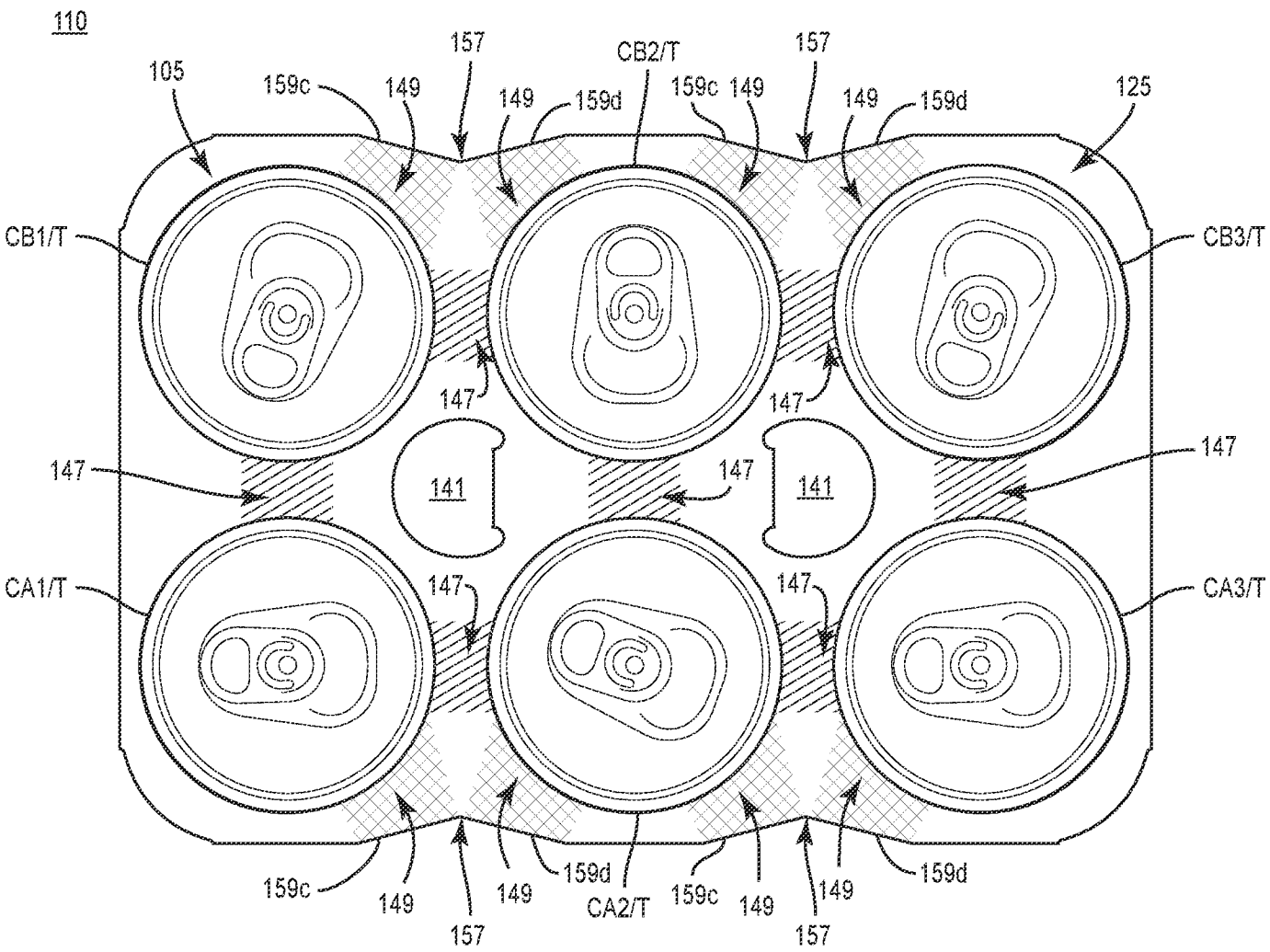
FIG. 4 is a plan view of the package of FIG. 2, with schematic annotations.
Figure 5:
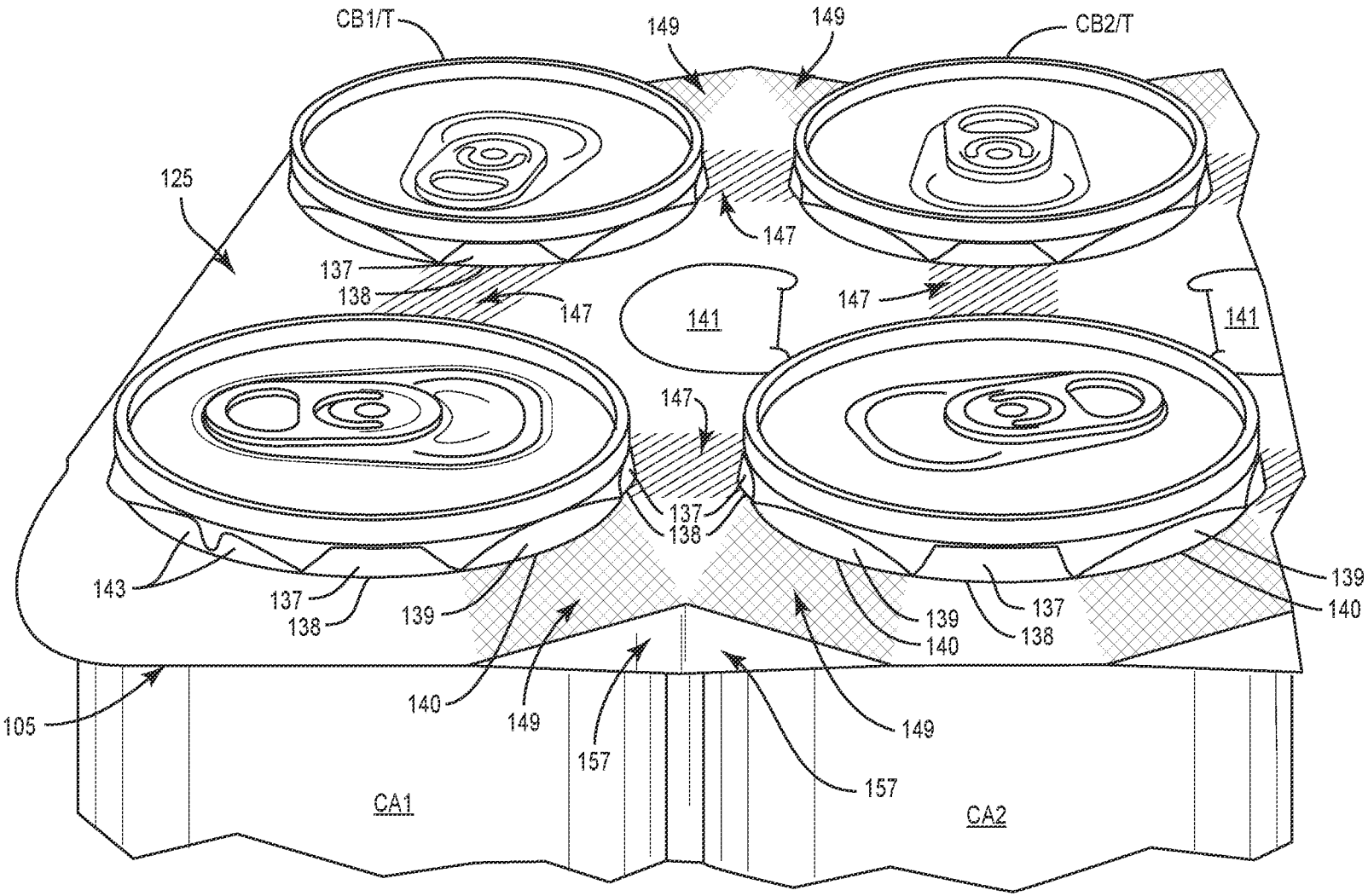
FIG. 5 is an enlarged perspective view of the package of FIG. 2, with schematic annotations.

The inner reinforcement portions 147, as shown with diagonal hatching in FIGS. 4 and 5, can be defined between/extending from opposed pairs of the curved fold lines 138, e.g., so as to be defined between the tops of adjacent containers in the package 110/laterally adjacent and longitudinally adjacent container retention openings 135 in the top panel 125. The arrangement of the curved fold lines 138 is such that respective sections having an at least partially arched/curved profile can be defined. In one embodiment, the curved fold lines 138 provide the respective inner reinforcement portions 147 with a generally pillow-shaped profile, e.g., generally rectangular with at a pair of concave long sides.

Furthermore, the outer reinforcement portions 149, as shown with cross-hatching in FIGS. 4 and 5, can be defined between edges of the top panel 125 adjacent the side reinforcement features 157, e.g., at respective fold line segments 159*c*, 159*d*, and the respective opposed curved lines 140. In this regard, the outer reinforcement portions 149 can have an at least partially arched/curved profile having at least one oblique side at the respective fold line segment 159*c*, 159*d* and at least one curved side at the respective curved fold lines 140.

Any of the panels, flaps, fold lines, cuts, or other features could be otherwise shaped, arranged, and/or omitted from the blank 103 without departing from the disclosure. The blank 103 could be sized and/or shaped to accommodate more or less than six containers without departing from this disclosure.

Figure 3:
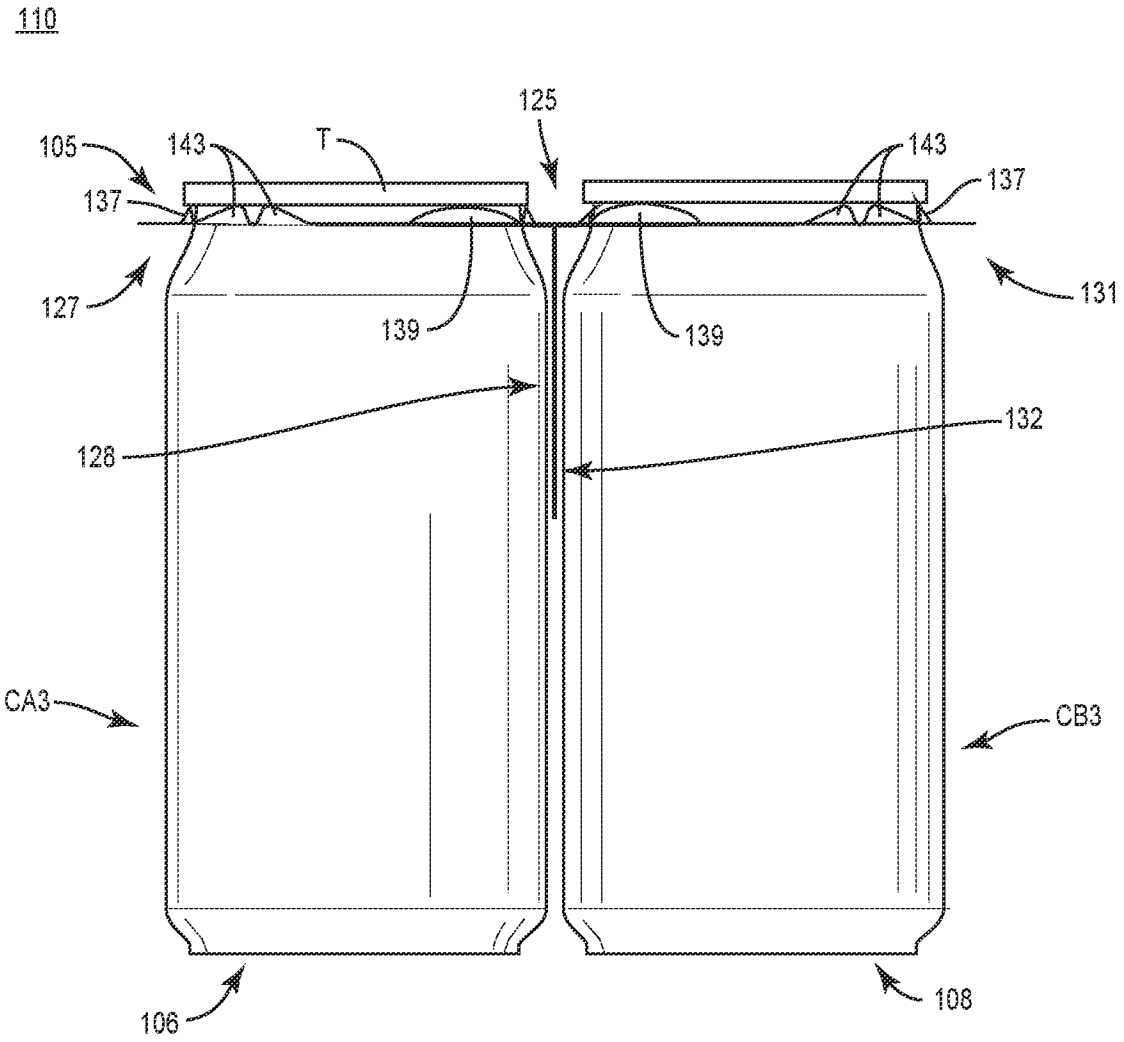
FIG. 3 is a side view of the package of FIG. 2.

With additional reference to FIGS. 2 and 3, according to one exemplary embodiment of forming the carrier 105/package 110, the blank 103 can be positioned above a group of containers and the container retention flaps 127, 131 can be folded toward the interior surfaced/underside of the blank 103 at the respective fold lines 129, 133 such that the container retention openings 146 of the respective container retention flaps 127, 131 align with the respective container retention openings 135 of the top panel 125.

Furthermore, the reinforcement flaps 128, 132 can be folded at the respective fold lines 130, 134 into at least partial face-to-face contact with one another and positioned extending downwardly from the top panel 125 and container retention flaps 127, 131 for being positioned between the containers CA1, CA2, CA3 in the front portion 106 of the carrier 105/package 110 and the containers CB1, CB2, CB3 in the back portion 108 of the carrier 105/package 110. It will be understood that the reinforcement flaps 128, 132 can provide a divider/separator/buffer between the containers CA1, CA2, CA3 in the front portion 106 of the carrier 105/package 110 and the containers CB1, CB2, CB3 in the back portion 108 of the carrier 105/package 110.

In such an arrangement, the blank 103 can be lowered upon the containers CA1, CA2, CA3, CB1, CB2, CB3 such that upper or top portions T of the respective containers CA1, CA2, CA3 can be at least partially received through the respective aligned container retention openings 135, 146.

Accordingly, the edge of the container retention flaps 127, 131 surrounding the respective container retention openings 146 at least partially receive a top portion T of the respective containers, e.g., a rolled rim of the respective containers, and the container retention openings 135 subsequently receive the respective top portions T of the respective containers.

Such movement of the respective top portions T of the respective containers through the respective container retention openings 167, 135 can cause the container retention tabs 143, 137, 139 to be urged upwardly at the respective fold lines 145, 138, 140 so as to extend at least partially upwardly relative to the top panel 125. In this regard, the container retention tabs 137, 139, 143 can extend from the top panel 125 to 161 to contact a respective container at the neck portion thereof below a respective flange. Such upward/oblique arrangement of the container retention tabs 137, 139, 143 extending from the top panel 125 to a top structure of the respective containers can provide a reinforced, braced, stabilized, etc. engagement of the blank 103/carrier 105 with the containers.

Furthermore, the overlapping relationship of respective portions of the top panel 125 with the container retention flaps 127, 131 is such that the container retention flaps 127, 131 provide an underlying support or shelf-like feature that can minimize/resist bending, buckling, flexion, torsion, etc. and provide a stable platform from which the top panel 125 and container retention tabs 137, 139, 143 extending upwardly therefrom are supported.

In addition to the support provided by the 2-ply/overlapping engagement of the top panel 125 with the container retention flaps 127, 131, the reinforcement features 157 are presented in an outward-facing arrangement relative to the top panel 125 and the container retention flaps 127, 131 so as to form a generally upright/vertical structure (e.g., relative to the top panel 125) that further minimizes/resists bending, buckling, flexion, torsion, etc. of the carrier 105/package 110 relative to a plane defined by the top panel 125 and/or the container retention flaps 127, 131, e.g., such that the carrier 105/package 110 minimizes/resists such forces/movement along both the longitudinal axis L1 and the lateral axis L2. In this regard, the reinforcement features 157 are positioned between the top panel 125 and the respective container retention flaps 127, 131.

Furthermore, the vertical positioning of the reinforcement flaps 128, 132 at the center of the carrier 105/package 110 is such that additional resistance to bending, buckling, flexion, torsion, etc. of the carrier 105/package 110 relative to a plane defined by the top panel 125 and/or the container retention flaps 127, 131 is provided, e.g., such that the carrier 105/package 110 minimizes/resists such forces/movement along both the longitudinal axis L1 and the lateral axis L2.

Further still, the arrangement of the inner reinforcement portions 147 and the outer reinforcement features further minimize/resist bending, buckling, flexion, torsion, etc. of the carrier 105/package 110 across a plane defined by the top panel 125. In particular, the arrangement of the opposed curved fold lines 140 that form the inner reinforcement portions 147 presents an arched or arch-like structure across the top panel that minimizes/resists compressive/bending forces thereacross. Similarly, the arrangement of the curved fold lines 138 opposite the respective oblique segments 159*c*, 159*d* of the respective lines of weakening 159 forms the outer reinforcement portions 149 as reinforced regions having at least one arched portion to minimize compressive/ bending forces thereacross. In one embodiment, one or more of the inner reinforcement portions 147 and the outer reinforcement portions 149 can form additional lines of weakening proximate a perimeter thereof upon compressive/bending forces being applied thereto, e.g., to further maintain the integrity/positioning of such reinforcement portions 147, 149.

Still referring to FIGS. 2 and 3, the package 110/carrier 105 can be grasped by a consumer by separating one or both handle tabs 141 from the top panel at the respective cuts 145 and folding the handle tab 141 downwardly at the respective fold line 144 to form a respective handle opening in the top panel 125 through which the user can insert one or more of his or her fingers. The portions of the apertures 153, 154 extending into the reinforcement flaps 128, 132 are thus positioned to provide clearance for one or more of a user's fingers extending through the handle openings formed by the handle tabs 141. In this regard, a user can engage the underside of the respective container retention flaps 127, 131 and/or a portion of the top panel 125, e.g., adjacent the respective recessed portion 153, 155, in order to engage and lift/carry or otherwise move the carrier 105/package 110. In one embodiment, the handle reinforcement flaps 141 can be positioned between a respective finger of the user and the underside of the carrier 105/package 110 to provide one or more additional plies of material, e.g., for comfort, to avoid pinching, etc. and/or to provide a reinforced structure for engagement by the user that is resistant to tearing or other deformation due to carrying stresses.

In addition, the oblique arrangement of the container retention tabs 139 relative to the handle tabs 141/openings formed therefrom enhances the resistance to bending, buckling, flexion, torsion, etc. of the top panel 125 and/or respective portions of the container retention flaps 127, 131 along both the longitudinal axis L1 and the lateral axis L2 when forces are exerted on the carrier 105/package 110 in the course of lifting, carrying, or otherwise moving the carrier 105/package 110 via engagement of the handle features by a user.

Upon formation of the package 110/carrier 105 respective containers CA1, CA2, CA3, CB1, CB2, CB3 can be removed from the carrier 105 by disengaging the container the top panel 125 and respective container retention flap 127, 131, for example, by moving the respective container retention tabs 137, 139, 143 away from the neck portion of a respective container and withdrawing the top portion T of a respective container through respective aligned container retention openings 135, 146.

It will be understood that the carrier 105/package 110 can have a different configuration without departing from the disclosure.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a top panel comprising a plurality of container retention openings for at least partially receiving a respective container of the plurality of containers;

a plurality of container retention flaps foldably connected to the top panel, the top panel comprises at least one container retention tab positioned adjacent a respective container retention opening and foldably connected to the top panel at a respective fold line;

a plurality of side reinforcement panels positioned between the top panel and the plurality of container retention flaps; and the top panel comprises at least one reinforcement portion extending from the respective fold line.

2. The carrier of claim 1, wherein the is side reinforcement panels are generally upright relative to the top panel.

3. The carrier of claim 2, wherein each side reinforcement panel is formed by a respective line of weakening.

4. The carrier of claim 3, wherein the respective line of weakening includes a respective plurality of oblique line segments, each oblique line segment of the respective plurality of oblique line segments intersecting at least one other oblique line segment of the respective plurality of oblique line segments.

5. The carrier of claim 4, wherein the reinforcement panels have a generally diamond-shaped configuration.

6. The carrier of claim 2, wherein the respective fold line is a respective curved fold line and the at least one container retention tab is positioned to extend into a respective container retention opening of the plurality of container retention openings.

7. The carrier of claim 6, wherein a respective at least one container retention tab is foldably connected to the top panel at a respective curved fold line and positioned to extend into a first container retention opening of the plurality of container retention openings, wherein a respective at least one container retention tab is foldably connected to the top panel at a respective curved fold line and positioned to extend into a second container retention opening of the plurality of container retention openings positioned adjacent the first container retention opening of the plurality of container retention openings, and the at least one reinforcement portion extends from the respective curved fold line at the first container retention opening to the respective curved fold line at the second container retention opening.

8. The carrier of claim 7, wherein the second container retention opening is laterally adjacent the first container retention opening.

9. The carrier of claim 7, wherein the second container retention opening is longitudinally adjacent the first container retention opening.

10. The carrier of claim 7, wherein the at least one reinforcement portion is a first reinforcement portion and the carrier further comprises a second reinforcement portion formed between a container retention opening of the plurality of container retention openings and a respective side reinforcement panel of the plurality of side reinforcement panels.

11. The carrier of claim 7, wherein each side reinforcement panel is formed by a respective line of weakening having a plurality of intersecting oblique segments, wherein the at least one container retention tab is an at least one first container retention tab and the respective curved fold line is a respective first curved fold line, wherein the carrier further comprises at least one second container retention tab foldably connected to the top panel at a respective second curved fold line and positioned to extend into a respective opening of the plurality of container retention openings, and wherein the second reinforcement portion extends from a respective second curved fold line to an oblique segment of the respective line of weakening.

12. The carrier of claim 11, wherein the at least one first container retention tab is aligned with one of a longitudinal axis and a lateral axis defined by the top panel, and the at least one second container retention tab is positioned adjacent the at least one first container retention tab.

13. The carrier of claim 12, wherein the at least one second container retention tab is obliquely positioned relative to the longitudinal axis and the lateral axis.

14. The carrier of claim 2, wherein the plurality of container retention openings in the top panel is a first plurality of container retention openings, the plurality of container retention flaps comprises a second plurality of container retention openings, the container retention openings of the first plurality of container retention openings being aligned with respective container retention openings of the second plurality of container retention openings.

15. The carrier of claim 2, further comprising a reinforcement flap foldably connected to a respective container retention flap of the plurality of container retention flaps and extending downwardly from the top panel and the plurality of container retention flaps.

16. The carrier of claim 1, wherein the at least one reinforcement portion is formed between a container retention opening of the plurality of container retention openings and a respective side reinforcement panel of the plurality of side reinforcement panels.

17. A blank for forming a carrier for holding a plurality of containers, the blank comprising:

a top panel comprising a plurality of container retention openings for at least partially receiving a respective container of the plurality of containers when the carrier is formed from the blank;

a plurality of container retention flaps foldably connected to the top panel, the top panel comprises at least one container retention tab positioned adjacent a respective container retention opening and foldably connected to the top panel at a respective fold line;

a plurality of side reinforcement panels positioned between the top panel and the plurality of container retention flaps; and the top panel comprises at least one reinforcement portion extending from the respective fold line.

18. The blank of claim 17, wherein each side reinforcement panel is formed by a respective line of weakening.

19. The blank of claim 18, wherein the respective line of weakening includes a respective plurality of oblique line segments, each oblique line segment of the respective plurality of oblique line segments intersecting at least one other oblique line segment of the respective plurality of oblique line segments.

20. The blank of claim 19, wherein the reinforcement panels have a generally diamond-shaped configuration.

21. The blank of claim 17, wherein the respective fold line is a respective curved fold line and the at least one container retention tab is positioned to extend into a respective container retention opening of the plurality of container retention openings.

22. The blank of claim 21, wherein a respective at least one container retention tab is foldably connected to the top panel at a respective curved fold line and positioned to extend into a first container retention opening of the plurality of container retention openings, wherein a respective at least one container retention tab is foldably connected to the top panel at a respective curved fold line and positioned to extend into a second container retention opening of the plurality of container retention openings positioned adjacent the first container retention opening of the plurality of container retention openings, and the at least one reinforcement portion extends from the respective curved fold line at the first container retention opening to the respective curved fold line at the second container retention opening.

23. The blank of claim 22, wherein the second container retention opening is laterally adjacent the first container retention opening.

24. The blank of claim 22, wherein the second container retention opening is longitudinally adjacent the first container retention opening.

25. The blank of claim 22, wherein the at least one reinforcement portion is a first reinforcement portion and the carrier further comprises a second reinforcement portion formed between a container retention opening of the plurality of container retention openings and a respective side reinforcement panel of the plurality of side reinforcement panels.

26. The blank of claim 22, wherein each side reinforcement panel is formed by a respective line of weakening having a respective plurality of intersecting oblique segments, wherein the at least one container retention tab is an at least one first container retention tab and the respective curved fold line is a respective first curved fold line, wherein the carrier further comprises at least one second container retention tab foldably connected to the top panel at a respective second curved fold line and positioned to extend into a respective opening of the plurality of container retention openings, and wherein the second reinforcement portion extends from a respective second curved fold line to an oblique segment of the respective line of weakening.

27. The blank of claim 26, wherein the at least one first container retention tab is aligned with one of a longitudinal axis and a lateral axis defined by the top panel, and the at least one second container retention tab is positioned adjacent the at least one first container retention tab.

28. The blank of claim 27, wherein the at least one second container retention tab is obliquely positioned relative to the longitudinal axis and the lateral axis.

29. The blank of claim 17, wherein the at least one reinforcement portion is formed between a container retention opening of the plurality of container retention openings and a respective side reinforcement panel of the plurality of side reinforcement panels.

30. The blank of claim 17, wherein the plurality of container retention openings in the top panel is a first plurality of container retention openings, the plurality of container retention flaps comprises a second plurality of container retention openings, the container retention openings of the first plurality of container retention openings being aligned with respective container retention openings of the second plurality of container retention openings.

31. A method of forming a carrier for holding a plurality of containers, the method comprising:

obtaining a blank comprising a top panel comprising a plurality of container retention openings, a plurality of container retention flaps foldably connected to the top panel, the top panel comprises at least one container retention tab positioned adjacent a respective container retention opening and foldably connected to the top panel at a respective fold line, a plurality of side reinforcement panels positioned between the top panel and the plurality of container retention flaps, the top panel comprises at least one reinforcement portion extending from the respective fold line; and positioning the blank such that the plurality of container retention openings is positioned for at least partially receiving a respective container of the plurality of containers.

32. The method of claim 31, further comprising positioning the at side reinforcement panels generally upright relative to the top panel.

33. The method of claim 32, wherein each side reinforcement panel is formed by a respective line of weakening.

34. The method of claim 33, wherein the respective line of weakening includes a respective plurality of oblique line segments, each oblique line segment of the respective plurality of oblique line segments intersecting at least one other oblique line segment of the respective plurality of oblique line segments.

35. The method of claim 34, wherein the reinforcement panels have a generally diamond-shaped configuration.

36. The method of claim 32, wherein the respective fold line is a respective curved fold line and the at least one container retention tab is positioned to extend into a respective container retention opening of the plurality of container retention openings.

37. The method of claim 36, wherein a respective at least one container retention tab is foldably connected to the top panel at a respective curved fold line and positioned to extend into a first container retention opening of the plurality of container retention openings, wherein a respective at least one container retention tab is foldably connected to the top panel at a respective curved fold line and positioned to extend into a second container retention opening of the plurality of container retention openings positioned adjacent the first container retention opening of the plurality of container retention openings, and the at least one reinforcement portion extends from the respective curved fold line at the first container retention opening to the respective curved fold line at the second container retention opening.

38. The method of claim 37, wherein the second container retention opening is laterally adjacent the first container retention opening.

39. The method of claim 37, wherein the second container retention opening is longitudinally adjacent the first container retention opening.

40. The method of claim 37, wherein the at least one reinforcement portion is a first reinforcement portion and the carrier further comprises a second reinforcement portion formed between a container retention opening of the plurality of container retention openings and a respective side reinforcement panel of the plurality of side reinforcement panels.

41. The method of claim 37, wherein each side reinforcement panel is formed by a respective line of weakening having a respective plurality of intersecting oblique segments, wherein the at least one container retention tab is an at least one first container retention tab and the respective curved fold line is a respective first curved fold line, wherein the carrier further comprises at least one second container retention tab foldably connected to the top panel at a respective second curved fold line and positioned to extend into a respective opening of the plurality of container retention openings, and wherein the second reinforcement portion extends from a respective second curved fold line to an oblique segment of the respective line of weakening.

42. The method of claim 41, wherein the at least one first container retention tab is aligned with one of a longitudinal axis and a lateral axis defined by the top panel, and the at least one second container retention tab is positioned adjacent the at least one first container retention tab.

43. The method of claim 42, wherein the at least one second container retention tab is obliquely positioned relative to the longitudinal axis and the lateral axis.

44. The method of claim 32, wherein the plurality of container retention openings in the top panel is a first plurality of container retention openings, the plurality of container retention flaps comprises a second plurality of container retention openings, and the method further comprises aligning the container retention openings of the first plurality of container retention openings with respective container retention openings of the second plurality of container retention openings.

45. The method of claim 32, further comprising a reinforcement flap foldably connected to a respective container retention flap of the plurality of container retention flaps, and the method further comprises positioning the respective reinforcement flap extending downwardly from the top panel and the plurality of container retention flaps.

46. The method of claim 31, wherein the at least one reinforcement portion is formed between a container retention opening of the plurality of container retention openings and a respective side reinforcement panel of the plurality of side reinforcement panels.

47. A package, the package comprising:

a plurality of containers; and a carrier holding the plurality of containers; the carrier comprising:

a top panel comprising a plurality of container retention openings at least partially receiving a respective container of the plurality of containers;

a plurality of container retention flaps foldably connected to the top panel, the top panel comprises at least one container retention tab positioned adjacent a respective container retention opening and foldably connected to the top panel at a respective fold line;

a plurality of side reinforcement panels positioned between the top panel and the plurality of container retention flaps; and the top panel comprises at least one reinforcement portion extending from the respective fold line.

48. The package of claim 47, wherein the side reinforcement panels are generally upright relative to the top panel.

49. The package of claim 48, wherein the plurality of container retention openings in the top panel is a first plurality of container retention openings, the plurality of container retention flaps comprises a second plurality of container retention openings, the container retention openings of the first plurality of container retention openings being aligned with respective container retention openings of the second plurality of container retention openings.

50. The package of claim 48, further comprising a reinforcement flap foldably connected to a respective container retention flap of the plurality of container retention flaps and extending downwardly from the top panel and the plurality of container retention flaps.

51. The package of claim 48, wherein each side reinforcement panel is formed by a respective line of weakening.

52. The package of claim 51, wherein the respective line of weakening includes a respective plurality of oblique line segments, each oblique line segment of the respective plurality of oblique line segments intersecting at least one other oblique line segment of the respective plurality of oblique line segments.

53. The package of claim 52, wherein the reinforcement panels have a generally diamond-shaped configuration.

54. The package of claim 48, wherein the respective fold line is a respective curved fold line and the at least one container retention tab is positioned to extend into a respective container retention opening of the plurality of container retention openings.

55. The package of claim 54, wherein a respective at least one container retention tab is foldably connected to the top panel at a respective curved fold line and positioned to extend into a first container retention opening of the plurality of container retention openings, wherein a respective at least one container retention tab is foldably connected to the top panel at a respective curved fold line and positioned to extend into a second container retention opening of the plurality of container retention openings positioned adjacent the first container retention opening of the plurality of container retention openings, and the at least one reinforcement portion extends from the respective curved fold line at the first container retention opening to the respective curved fold line at the second container retention opening.

56. The package of claim 55, wherein the at least one side reinforcement panel is formed by a respective line of weakening having a respective plurality of intersecting oblique segments, wherein the at least one container retention tab is an at least one first container retention tab and the respective curved fold line is a respective first curved fold line, wherein the carrier further comprises at least one second container retention tab foldably connected to the top panel at a respective second curved fold line and positioned to extend into a respective opening of the plurality of container retention openings, and wherein the second reinforcement portion extends from a respective second curved fold line to a respective oblique segment of the respective line of weakening.

57. The package of claim 56, wherein the at least one first container retention tab is aligned with one of a longitudinal axis and a lateral axis defined by the top panel, and the at least one second container retention tab is positioned adjacent the at least one first container retention tab.

58. The package of claim 57, wherein the at least one second container retention tab is obliquely positioned relative to the longitudinal axis and the lateral axis.

59. The package of claim 55, wherein the second container retention opening is laterally adjacent the first container retention opening.

60. The package of claim 55, wherein the second container retention opening is longitudinally adjacent the first container retention opening.

61. The package of claim 55, wherein the at least one reinforcement portion is a first reinforcement portion and the carrier further comprises a second reinforcement portion formed between a container retention opening of the plurality of container retention openings and a respective side reinforcement panel of the plurality of side reinforcement panels.

62. The package of claim 47, wherein the at least one reinforcement portion is formed between a container retention opening of the plurality of container retention openings and a respective side reinforcement panel of the plurality of side reinforcement panels.

* * * * *